United States Patent [19]

Fitzmayer

[11] 4,316,069

[45] Feb. 16, 1982

[54] MICROWAVE OVEN EXCITATION SYSTEM

[75] Inventor: Louis H. Fitzmayer, Lousville, Ky.

[73] Assignee: General Electric Company, Louisville, Ky.

[21] Appl. No.: 99,454

[22] Filed: Dec. 3, 1979

[51] Int. Cl.[3] ..... H05B 6/72

[52] U.S. Cl. ..... 219/10.55 F; 219/10.55 R

[58] Field of Search ..... 219/10.55 F, 10.55 R, 219/10.55 D, 10.55 E, 10.55 A

[56] References Cited

U.S. PATENT DOCUMENTS

| | | | |
|---|---|---|---|
| 2,961,520 | 11/1960 | Long | 219/10.55 F |
| 3,619,536 | 11/1971 | Boehm | 219/10.55 F |
| 3,746,823 | 7/1973 | Whiteley | 219/10.55 F |
| 3,819,900 | 6/1974 | Ironfield | 219/10.55 F |
| 3,823,295 | 7/1974 | Simon et al. | 219/10.55 R |
| 3,851,133 | 11/1974 | Dygve et al. | 219/10.55 F |
| 3,934,106 | 1/1976 | Macmaster et al. | 219/10.55 E |
| 4,027,133 | 5/1977 | Dygve et al. | 219/10.55 F |
| 4,028,521 | 6/1977 | Uyeda et al. | 219/10.55 F |
| 4,162,380 | 7/1979 | Burke | 219/10.55 D X |

FOREIGN PATENT DOCUMENTS

| | | | |
|---|---|---|---|
| 2622173 | 12/1976 | Fed. Rep. of Germany | 219/10.55 F |
| 2844128 | 4/1979 | Fed. Rep. of Germany | 219/10.55 F |
| 54-106949 | 8/1979 | Japan | 219/10.55 F |

*Primary Examiner*—B. A. Reynolds
*Assistant Examiner*—Philip H. Leung
*Attorney, Agent, or Firm*—Radford M. Reams

[57] ABSTRACT

An excitation system for a microwave oven in which a rotating microwave field is established in a waveguide section prior to being propagated into the microwave oven cavity. A circular waveguide has an internal L-shaped rotating antenna excited from a coupling probe in an attached rectangular waveguide to establish in the waveguide a stationary TM01 and a TE11 mode. These modes interact in the waveguide to give an asymmetric rotating waveguide field which is then propagated into the oven to provide a rotating field pattern of desirable average uniformity. The excitation circular waveguide is located in a central position on the bottom wall of the oven.

16 Claims, 6 Drawing Figures

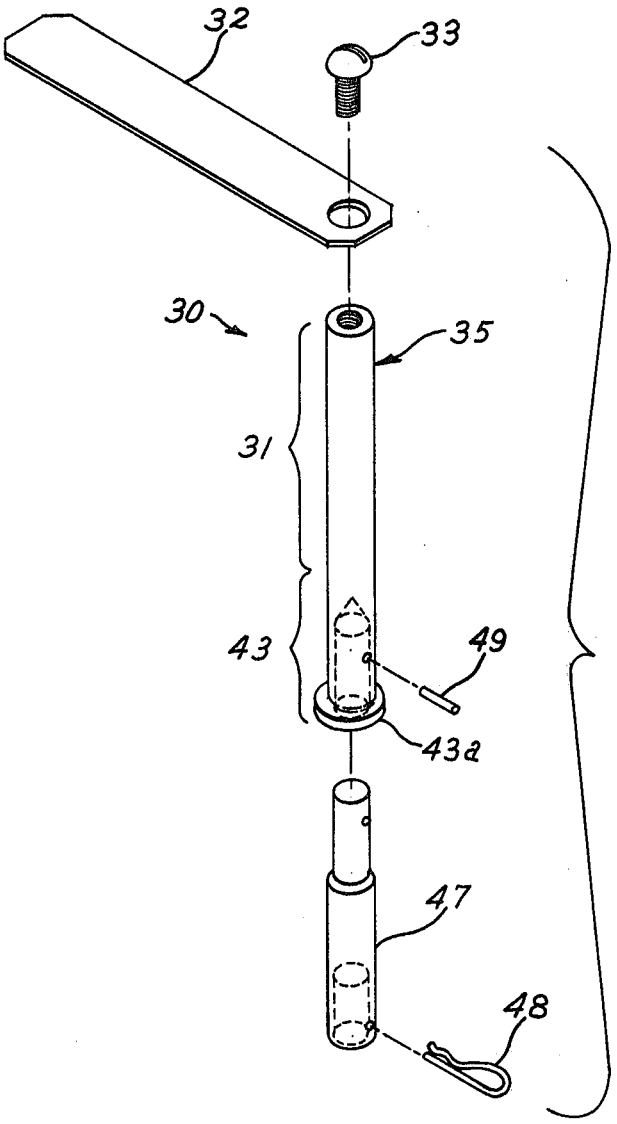
FIG. 4
FIG. 5
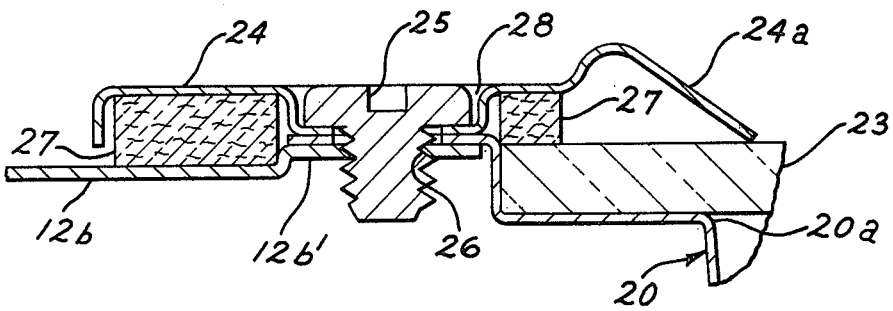

MICROWAVE OVEN EXCITATION SYSTEM

BACKGROUND OF THE INVENTION

The present invention is directed to a microwave oven excitation system and more specifically to a system which couples a continuously moving asymetric field into the oven cavity so as to provide improved uniformity of field distribution within the oven cavity during a selected cooking cycle.

In a microwave oven cooking cavity, the spatial distribution of the microwave energy tends to be non-uniform. As a result, "hot spots" and "cold spots" are produced at different locations. For many types of foods, cooking results are unsatisfactory under such conditions because some portions of the food may be completely cooked while others are barely warmed. The problem becomes more severe with foods of low thermal conductivity which do not readily conduct heat from the areas which are heated by the microwave energy to those areas which are not. An example of a food falling within this class is cake. However, other foods frequently cooked in microwave ovens, such as meat, also produce unsatisfactory cooking results if the distribution of microwave energy within the oven cavity is not uniform.

One explanation for the non-uniform cooking pattern is that electromagnetic standing wave patterns, known as "modes", are set up within the cooking cavity. When a standing wave pattern is established, the intensities of the electric and magnetic fields vary greatly with position. The precise configuration of the standing wave or mode pattern is dependent upon a number of factors including the frequency of microwave energy used to excite the cavity and the dimensions of the cavity itself. It is possible theoretically to predict the particular mode patterns which may be present in the cavity, but actual experimental results are not always consistent with theory. This is particularly so in microwave ovens operating at a frequency of 2450 MHz. Due to the relatively large number of theoretically possible modes, it is difficult to predict with certainty which of the modes will exist. The situation is further complicated by the differing loading effects of different types and quantities of food which may be placed in the cooking cavity.

A number of different approaches to altering the standing wave patterns have been tried in an effort to alleviate the problem of non-uniform energy distribution. The most common approach is the use of a device known as a "mode stirrer", which typically resembles a fan having metal blades. The mode stirrer rotates and may be placed either within the cooking cavity itself or within a recess formed in one of the cooking cavity walls, typically located at the top of the oven cavity. The intended function of the mode stirrer is to alter the mode pattern in the oven cavity so that the "hot" and "cold" spots are continually shifted resulting in the energy distribution in the cavity being made more uniform when averaged over a period of time.

Although the use of a mode stirrer improves energy distribution in the cavity, it has been found in practice that uneven energy distribution can still exist. For example, depending on the characteristics of a particular cavity and the feed aperture used to inject the microwave energy into the cavity, it is possible to have a region at one side of the cavity at a significantly higher strength than exists on the opposite side. Uneven distribution can also occur in the front to back direction.

Another approach to achieving more uniform cooking of food load in the oven is to employ a rotating table on which the food load is placed. The theory is that as the food load is rotated through "hot" and "cold" spots in the mode pattern, the averaged heating of the food will result in relatively uniform cooking. Although somewhat helpful to this end, in actual practice, the results depend on the particular mode pattern established in a given oven and on the nature of the food load. For example, a vertically polarized predominantly TE mode will not perform satisfactorily in cooking horizontally placed bacon strips despite the use of the rotating table. Moreover, a mode pattern that produces a low energy level in the center of the oven will cause the axial portion of the rotating food load to remain less well cooked than in the peripheral sections of the load which pass through higher energy regions in the cavity.

Yet another prior art approach involves the use of a rotating antenna within the oven cavity intended to couple a rotating horizontal field into the cavity. However, it has been found that this approach is not entirely satisfactory apparently due to the fact that the vertical field coupled into the cavity is the predominant mode and is, of course, stationary. The minor horizontal field coupled by the rotating horizontal antenna segment is inadequate to significantly alter the more dominant stationary vertical field modes and, as a result, field uniformity in the oven cavity is not desirably realized.

It is, therefore, an object of the present invention to provide an excitation system for a microwave oven that will serve to improve the uniformity of energy distribution in the oven cavity during a cooking cycle over presently known techniques.

SUMMARY OF THE INVENTION

Thus, in accordance with the invention, there is provided a microwave oven excitation system for an oven cavity having top, bottom, and side walls in which the excitation system which comprises, in part, a waveguide section adapted to be in microwave energy communication with the oven cavity through one of the oven walls comprising an entrant wall thereof. Movable antenna means are mounted within the waveguide section, the antenna means having a first segment parallel with the propogation axis of the waveguide and a second segment orthogonal to the waveguide axis. The system further includes means for moving the antenna and means for coupling microwave energy to the antenna to excite a moving asymmetric electric field within the waveguide as the antenna is moved, the field having a substantial energy mode parallel to the entrant wall of the oven cavity. With this system, a moving asymmetric electric field is coupled through the entrant wall to excite in the oven cavity a time varying electric field pattern of desirable average uniformity during a cooking cycle.

In one preferred form of the invention, a circular waveguide section is attached in a centrally located position to the bottom wall of the oven and a rotatable antenna having a vertical segment and a horizontal arm is rotated to excite, within the waveguide section, the TM01 mode by the vertical segment and the TE11 mode by the horizontal arm. These two modes interact to excite a rotating asymmetric electric field within the waveguide having a substantial horizontal field component. This rotating asymmetric waveguide field is then propogated into the oven cavity to produce a rotating field pattern of desirable average uniformity in the oven cavity during a cooking cycle.

BRIEF DESCRIPTION OF THE DRAWINGS

In the drawings:

FIG. 4 is an exploded view of the antenna employed in the system of FIGS. 2 and 3; and FIG. 5 is a side view of a portion of the FIG. 3 structure showing the details of a preferred manner of attaching the excitation system to the oven wall.

DESCRIPTION OF THE PREFERRED EMBODIMENT

Figure 1:
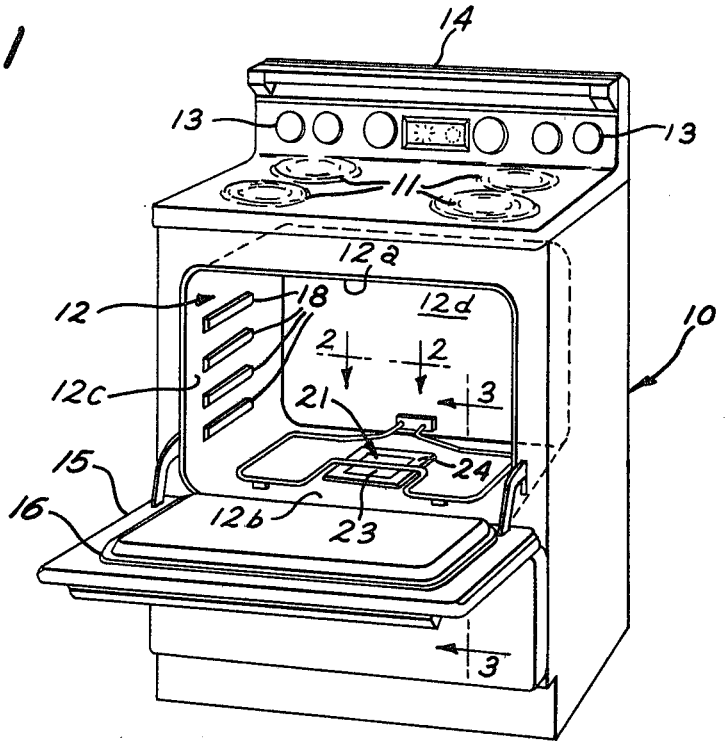
FIG. 1 is a perspective view of an electric range having a microwave oven embodying one form of the present invention.

Referring now to FIG. 1, there is shown a free standing electric range 10, which, for the most part, is conventional in construction. Thus, range 10 includes surface heating units 11, an oven cavity 12, and related controls 13 mounted on back panels 14. Oven cavity 12 is formed by horizontal top and bottom walls 12*a*, 12*b* and upstanding side walls 12*c*, 12*d*, 12*e*. An oven door 15 is hingedly mounted on the front wall of range 10 and may be provided with a fiberglass gasket 16 to provide a heat seal for the oven cavity 12 when door 15 is closed. When a microwave cooking operation is performed, it is necessary also to seal the periphery of the door against microwave energy leakage. To this end, the gasket 16 may also include a conductive wire mesh in contact with the front periphery of over cavity 12. Other means of sealing against microwave energy leakage may also be employed in accordance with principles well known in the art. The oven includes a conventional lower bake heater unit 17 and an upper broiler heater unit (not shown). A series of parallel rack supporting ridges 18 are formed on side walls 12*c* and 12*e* such that conventional wire racks (not shown) may be slidably supported in the usual manner.

Figure 2:
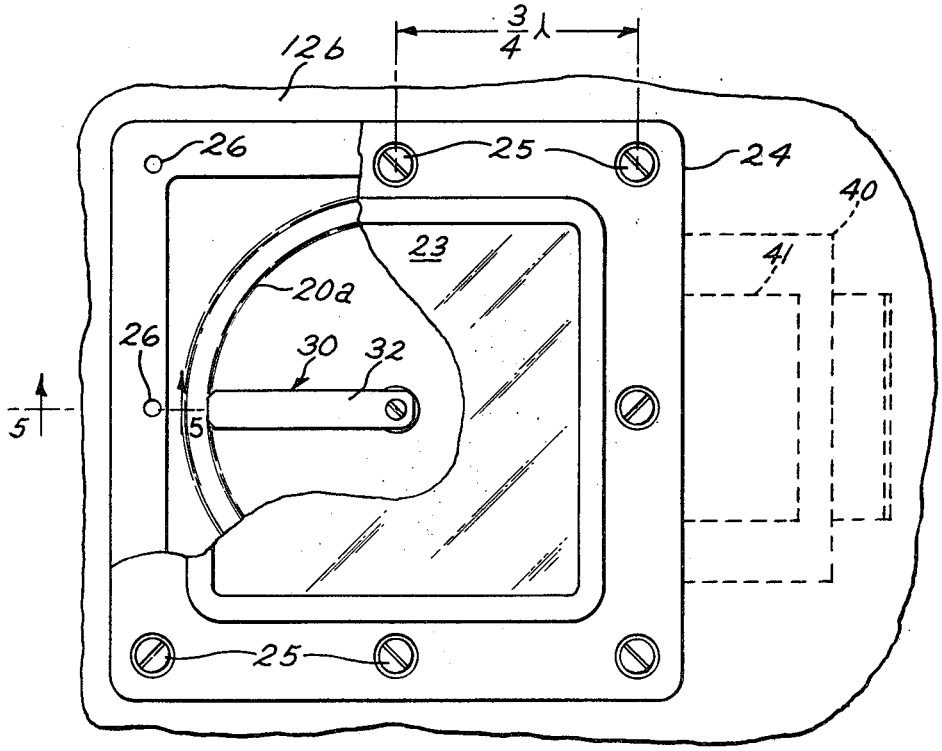
FIG. 2 is a top view, partially cut away, of a representative embodiment of the excitation system of the present invention.
Figure 3:
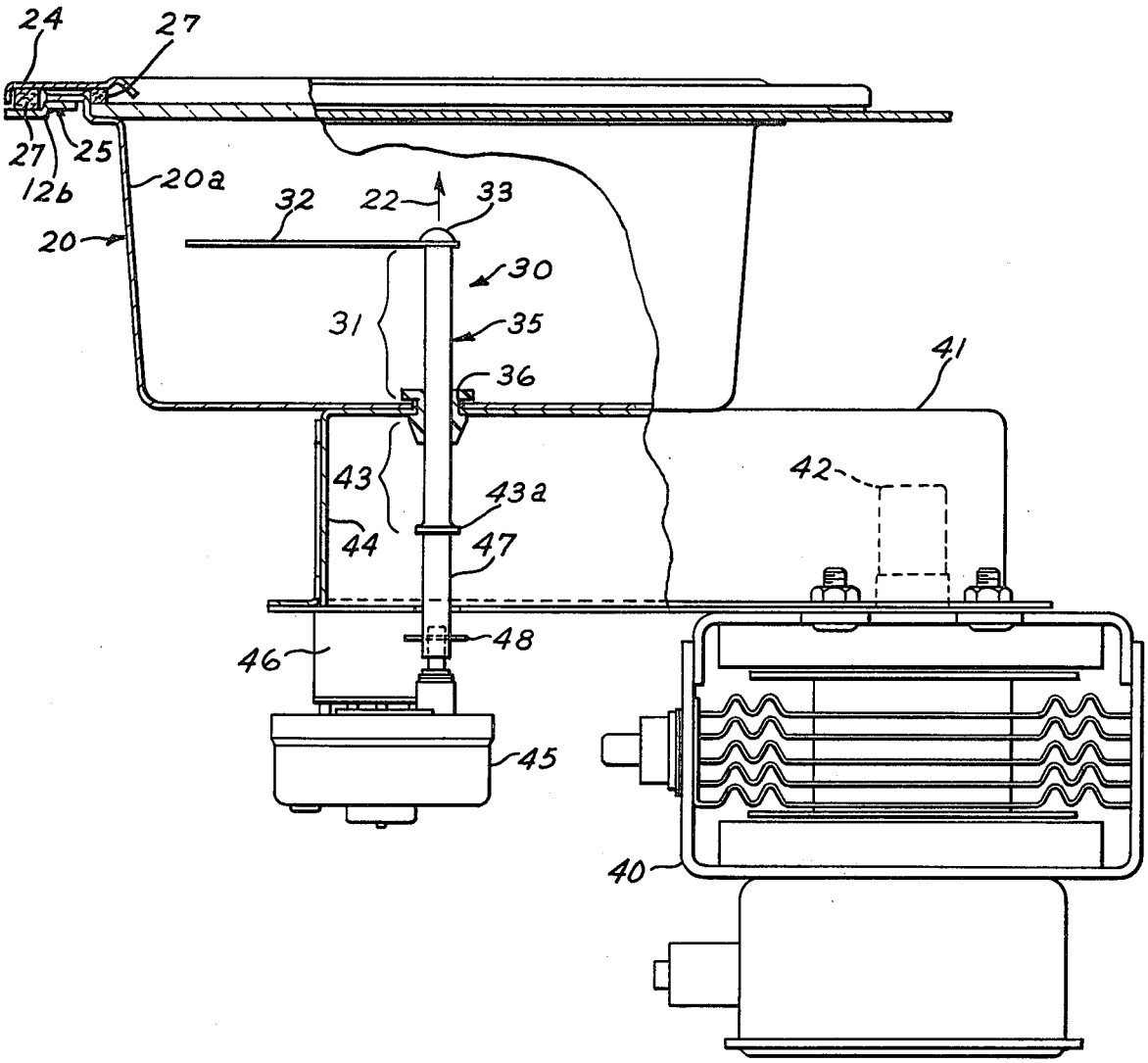
FIG. 3 is a side view, partially cut away, of the excitation system of FIG. 2 illustrating the structural details thereof.

Referring now jointly to FIGS. 1–3, in accordance with the invention, a microwave oven excitation system includes a waveguide section 20 adapted to be in microwave energy communication with oven cavity 12 which may be through one of the walls 12*a*–12*d* of oven cavity 12, the selected wall thus comprising an entrant wall for the microwave energy. In the illustrated embodiment of FIGS. 1 and 3, waveguide section 20 is outside oven cavity 12 and is attached to bottom wall 12*b* with the upper, open end thereof aligned with and in mating engagement with a feed aperture in the bottom entrant wall 12*b*. In a preferred form of the invention, the feed aperture 21 is centrally positioned on bottom entrant wall 12*b* although the invention may also be practiced with the aperture located off-center. Also the choice of the bottom wall 12*b* as being the entrant wall is dictated in the case of range 10 by factors unrelated to the invention and any one of the other walls 12*a*, 12*c*, 12*d* or 12*e* might also be chosen depending on available space considerations. For example, in a countertop microwave oven, it is common practice to use the top wall as the entrant wall and this invention may also be employed in such a manner.

Waveguide 20, preferably a circular waveguide although other configurations may be employed, is attached to entrant wall 12*b* with its guide or propagation axis 22 perpendicular to the entrant wall 12*b*. Waveguide 20 may be formed out of a square metal sheet by a draw process and thus for convenience, a slight taper in the side walls 20*a* of the waveguide are provided. The upper end of waveguide 20 is closed by a layer or plate 23 of a low dielectric material such as, for example, a glass ceramic, the basic function of which is to prevent food soil and other objects from entering waveguide 20. Plate 23 is held in place by a metal trim frame 24 attached to waveguide 20 and entrant wall 12*b* by means of screws 25 through mating screw holes 26. As gasket 27 is interposed between trim frame 24 to electrically insulate trim frame 24 from the waveguide 20 and entrant wall 12*b* except at the contact points provided by screws 25. More specifically, and with reference to FIG. 5, frame 24 is provided with depressions around the screw holes 26 that nest into mating holes of insulator gasket 27 to assure contact with waveguide 20 and entrant wall 12*b*. Also, entrant wall 12*b* has a slightly raised portion 12*b*′ thus assuring that trim frame 24 does not contact entrant wall 12*b* except at the screw contact points. As seen in FIG. 2, the screw contact points are spaced apart by a distance $\frac{3}{4}\lambda$ to assure that circulating currents are not established in trim frame 24 which thereby has the effect of suppressing unwanted load-in of microwave energy into the trim frame 24 which, if allowed to occur, would reduce the feed-in of energy into oven cavity 12.

Still in accordance with the invention, movable antenna means 30 are mounted within waveguide 20 with a first or vertical segment 31 being parallel and preferably coaxial with the central propagation axis 22 of waveguide 20, and with a second segment or arm 32 thereof being orthogonal to axis 22. As shown in FIGS. 3 and 4, antenna 30 is of two-piece construction joined at the right angle intersection thereof by means of bolt 33, although it will be appreciated that any generally L-shaped antenna may be employed, as for example, a one-piece having an approximately right angle bend in the vicinity of the illustrated bolt attachment. In the embodiment of FIGS. 3 and 4, segment 31 comprises the upper portion of a unitary, electrically conductive rod 35, the lower portion of which comprises a coupling probe 43 extending into rectangular waveguide 41.

Figure 3A:
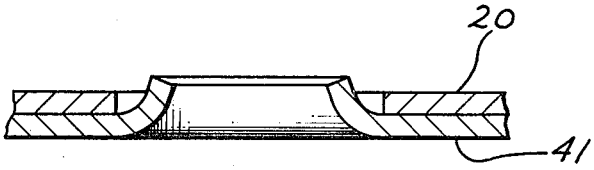
FIG. 3*a* is a blown up view of a portion of the FIG. 3 structure.

The microwave excitation system also comprises means for coupling microwave energy to antenna 30. This means includes a conventional magnetron 40, operating preferably at the standard frequency of 2450 MHz, and includes a rectangular waveguide 41. Microwave energy generated by magnetron 40 is coupled into waveguide 41 in conventional manner by a fixed antenna stub 42. The energy is then propagated along the length of waveguide 41 and is coupled by means of coupling probe 43 to antenna 30. As previously noted, the functional components comprising the coupling probe 43 and antenna segment 31 are integral parts of unitary rod 35 in the illustrated embodiment, however, it is convenient to refer to these functional components as though they were physically separate units. It will be appreciated that the employment of a unitary rod is merely a matter of choice as in fact, separate units might also be employed provided they are appropriately electrically connected as, for example, by a mating screw threaded connection. When a unitary rod is employed, as illustrated, the functional components are determined by the vertical positioning of the rod in the assembled excitation. Thus, the positioning of the rod is carefully determined so that the respective lengths of coupling probe 43 and antenna segment 31 are suitable for operation at the microwave frequency of 2450 MHz. Rectangular waveguide 41 is attached to the lower end of circular waveguide 20, the two guides having mating holes through which rod 35 extends. A grommet 36 of low loss dielectric material such as tetrafluoroethylene ("Teflon") is included to aid in holding rod 35 in place. The fit between rod 35 and grommet 36, which is snug, is sufficiently loose to allow rotational movement of rod 35. As seen in FIG. 3*a*, the hole in rectangular waveguide 41 is flanged upwards slightly to fit within the mating hole in the bottom of circular waveguide 20 to minimize arcing caused by the heavy field concentration in the vicinity of the holes.

The excitation system of the present invention also comprises means for moving antenna 30 as it is being excited by microwave energy from coupling probe 43 so as to excite within waveguide 20 a moving asymmetric electric field, with the field having a substantial moving energy mode parallel to entrant wall 12*b* of the oven cavity 12 which is caused by the translational movement of antenna arm 32. In the embodiment of FIG. 3, a motor 45 which may, for example, operate at a rotational frequency of 120 RPM is secured to the underside of rectangular waveguide 41 by a suitable bracket 46 and has its rotor shaft attached via a drive rod 47 to the lower end of rod 35 thereby rotating the horizontal antenna arm 32 when power is applied to motor 45. The shaft of motor 45 may be secured to drive rod 47 with a hitch pin clip 48 while drive rod 47 preferably is secured to coupling probe 43 by a conventional roll pin 49. Drive rod 47 may be comprises of electrically non-conductive material such as tetrafluoroethylene ("Teflon"). Alternatively, other types of conventional non-conductive materials having slightly higher dielectric constants and loss factors than Teflon may be employed. Depending on the electrical characteristics of the material used for drive rod 47 it may be necessary, and in fact it is preferable, to minimize the electric field concentration at the point where drive rod 47 and coupling probe 43 join together. To this end, in the embodiment of FIGS. 3 and 4, the bottom of coupling probe 43 is provided with an increased diameter segment such as flange 43*a*, to reduce the microwave field concentration in the vicinity of the top of drive rod 47. This reduces the loading-in of microwave energy to the drive rod 47 and thus avoids heating up of the material of drive rod 47 which could shorten its operating life. In the case of Teflon, it may not be necessary to employ the flange 43*a*. Motor 45 provides unidirectional rotational movement of antenna 30 although it will be appreciated that other modes of antenna movement, such as reciprocating oscillatory translation of arm 32 in a plane generally orthogonal to the propagation axis of waveguide 20 are within the scope of the invention.

In operation of the microwave excitation system of FIG. 3 when power is applied to magnetron 40 and antenna drive motor 45, antenna 30 is rotated to excite a rotating field within waveguide 20 having a stationary TM01 field mode excited by the vertical antenna segment 31 and a rotating horizontal, TE11 field mode excited by the rotating horizontal antenna arm 32. These two modes interact within waveguide 20 to form a rotating asymmetric electric field which is then propagated through the entrant wall 12*b* into oven cavity 12 to form a time varying or rotating electric field pattern. In this manner, there is provided within oven cavity 12 a microwave energy field pattern of desirable average uniformity during a cooking cycle. In tests performed on an actually constructed embodiment, it was found that this field pattern within oven cavity 12 was not significantly adversely affected by the size or positioning of the food load within the oven.

By way of example, and with no intention to be limited thereto, the following dimensions were employed in the actually constructed embodiment just referred to. The length of circular waveguide 20 while not critical was set at approximately 2.4 inches and preferably could be set at any multiple of one-half wavelength. The diameter was set at slighly greater than one wavelength or approximately 5 inches. The antenna dimensions were approximately $\lambda/4$ or 1.2 inches for vertical segment 31 and $\lambda/2$ or 2.4 inches for horizontal arm 32. The diameter of waveguide 20 and the length of horizontal arm 32 are preferably set so as to provide sufficient clearance between the distal end of arm 32 and the side wall of waveguide 20 to avoid arcing. A clearance of 0.2–0.3 inch is considered sufficient for this purpose. The rectangular waveguide 41 dimensions were 3.4 inches wide, 6.8 inches long and 1.7 inches high. The length of coupling probe 43 was approximately one quarter wavelength or 1.2 inches.

As can be seen from the foregoing description, a highly effective microwave excitation system has been disclosed in which a moving or rotating excitation field is generated in a waveguide which is then propagated into the microwave oven cavity to provide a field pattern of highly uniform average density. In most cases, it will be preferred to locate the excitation waveguide section outside the oven cavity with the rotating field being propagated through the entrant wall into the oven cavity. However, it is possible and within the spirit and scope of the invention to position the excitation waveguide section inside the oven cavity, the rotating field then being propagated into the oven cavity without passing through an exterior entrant wall.

While, in accordance with the patent statutes, there has been described what at present is considered to be one or more preferred embodiments of the present invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. A microwave oven excitation system for an oven cavity having top, bottom and side walls, the system comprising:

a waveguide section adapted to be in microwave energy communication with the oven cavity through one of said walls comprising an entrant wall of the oven cavity;

movable antenna means mounted completely within the waveguide section having a first segment parallel to the propagation axis of the waveguide and a second segment orthogonal to said axis;

means for moving the antenna;

and means for coupling microwave energy to the antenna to excite a moving asymmetric electric field within the waveguide as the antenna is moved, said field having a substantial energy mode parallel to the entrant wall of the oven cavity, whereby said moving asymmetric electric field is coupled through said entrant wall to excite within the oven cavity a time varying electric field pattern of desirable average uniformity during a cooking cycle.

2. The microwave oven excitation system of claim 1 wherein the entrant wall has a microwave feed aperture and wherein the wave guide section is a circular waveguide attached to the entrant wall in mating engagement with the feed aperture and with the propagation axis of the waveguide section being perpendicular to the entrant wall.

3. The microwave oven excitation system of claim 1 or claim 2 wherein the antenna means is rotatable within the waveguide section and wherein said first antenna segment is coaxial with the propagation axis of the waveguide section.

4. The microwave oven excitation system of claim 1, 2, or 3 wherein said entrant wall comprises the bottom wall of the oven.

5. The microwave oven excitation system of claim 1, 2, or 3 wherein said entrant wall comprises the bottom wall of the oven and wherein the waveguide section is attached to the entrant wall at a central position on the entrant wall.

6. The microwave oven excitation system of claim 2 wherein the length of the circular waveguide is approximately equal to $n\lambda/2$ where n is an integer and $\lambda$ is the principal wavelength of said microwave energy coupled to the antenna.

7. The microwave oven excitation system of claim 6 wherein said waveguide length is approximately $\lambda/2$ wherein the nominal waveguide diameter is approximately $\lambda$ with sufficient spacing between the sidewall of the waveguide and the distal end of the movable antenna to avoid arcing therebetween.

8. A microwave oven excitation system for an oven cavity having top, bottom and side walls, the system comprising:

a circular waveguide section adapted to be in microwave energy communication with the oven cavity through either of the top or bottom walls comprising an entrant wall of the oven cavity;

a rotatable generally L-shaped antenna mounted completely within the waveguide section having a vertical segment approximately $\lambda/4$ in length coaxial with the axis of the waveguide and a horizontal arm approximately $\lambda/2$ in length;

means for rotating the antenna;

and means for coupling microwave energy of wavelength $\lambda$ to the antenna to excite, within the waveguide section, the TM01 mode by the vertical antenna segment and TE11 mode by the horizontal arm of the antenna, the two modes interacting to form within the waveguide an asymmetric rotating field having a substantial horizontal field component;

whereby said rotating waveguide field is propagated through said entrant wall into the oven cavity to excite therein a rotating electric field pattern having a desirable average uniformity in the oven cavity during a cooking cycle.

9. The microwave oven excitation system of claim 8 wherein the waveguide section is symmetrically mounted at a central position on the bottom wall of the oven.

10. The microwave oven excitation system of claim 8 wherein the waveguide is attached to the bottom wall of the oven cavity and the opening of the waveguide into the oven cavity is closed by a closure member comprised of a layer of low dielectric material.

11. The microwave oven of claim 10 wherein the closure is held in place by means including a metal trim member attached to the waveguide section and entrant wall only at points spaced $\frac{3}{4}\lambda$ apart to suppress load-in of microwave energy to the trim member.

12. A microwave oven excitation system for an oven cavity, the system comprising:

a waveguide section adapted to be in microwave energy communication with the oven cavity;

movable antenna means, mounted completely the waveguide section, having a first segment thereof parallel to the propagation axis of the waveguide and a second segment thereof orthogonal to said axis;

means for moving the antenna to cause translational movement of the second antenna segment in a plane orthogonal to the propagation axis of the waveguide;

and means for coupling microwave energy to the antenna to excite a moving asymmetric electric field within the waveguide as the antenna is moved;

whereby said moving asymmetric field is propagated into the oven cavity to excite, within the oven cavity, a time varying electric field pattern of desirable average uniformity during a cooking cycle.

13. A microwave oven excitation system comprising:

an oven cavity having top, bottom, and side walls, one wall of which comprises an entrant wall having a feed aperture therein;

a circular waveguide mounted on said entrant wall outside the oven cavity with one end of the waveguide being aligned with the feed aperture;

a generally L-shaped rotatable antenna mounted within the waveguide having a first segment extending into the waveguide parallel to the propagation axis thereof and a second segment extending generally at a right angle to the first segment;

a rectangular waveguide attached to the end of the circular waveguide which is remote from said oven entrant wall;

means for coupling microwave energy into the rectangular waveguide;

a coupling probe in the rectangular waveguide and connected to the antenna for coupling the microwave energy to the antenna;

and means for rotating the antenna to excite, within the circular waveguide, a stationary $TM_{01}$ mode with the first antenna segment and a rotating $TE_{11}$ mode with the second antenna segment; whereby an asymmetric rotating electric field is propagated into the oven cavity to excite a rotating electric field pattern having a desirable average uniformity during a cooking cycle.

14. The excitation system of claim 13 wherein the coupling probe and first antenna segment comprise an integral electrically conductive shaft coaxial with the central axis of the circular waveguide.

15. The excitation system of claim 13 or 14 wherein the means of rotating the antenna includes a motor and a length of non-conductive material operationally connecting the motor to the antenna via the coupling probe.

16. The excitation system of claim 15 wherein the coupling probe has a first diameter over substantially its entire length and a second diameter larger than said first diameter at the end at which the coupling probe is joined with said length of non-conductive material included in the antenna rotating means.

* * * * *

UNITED STATES PATENT AND TRADEMARK OFFICE

CERTIFICATE OF CORRECTION

PATENT NO. 4,316,069

DATED February 16, 1982

INVENTOR(S) Louis H. Fitzmayer

It is certified that error appears in the above-identified patent and that said Letters Patent are hereby corrected as shown below:

Column 8, Claim 12, line 12, after "completely" insert --within--.

Signed and Sealed this

*Twentieth* Day of *April 1982*

[SEAL]

*Attest:*

GERALD J. MOSSINGHOFF

*Attesting Officer*

*Commissioner of Patents and Trademarks*